US012540467B2

(12) United States Patent
Yoshitaka

(10) Patent No.: US 12,540,467 B2
(45) Date of Patent: Feb. 3, 2026

(54) CONSTRUCTION METHOD FOR PLANT FACILITY AND PLANT CONFIGURING MODULE

(71) Applicant: IMAC ENGINEERING CO., LTD., Tokyo (JP)

(72) Inventor: Izumi Yoshitaka, Tokyo (JP)

(73) Assignee: IMAC ENGINEERING CO., LTD., Tokyo (JP)

( * ) Notice: Subject to any disclaimer, the term of this patent is extended or adjusted under 35 U.S.C. 154(b) by 0 days.

(21) Appl. No.: 17/298,295

(22) PCT Filed: May 29, 2019

(86) PCT No.: PCT/JP2019/021413
§ 371 (c)(1),
(2) Date: May 28, 2021

(87) PCT Pub. No.: WO2020/240745
PCT Pub. Date: Dec. 3, 2020

(65) Prior Publication Data

US 2022/0049491 A1 Feb. 17, 2022

(51) Int. Cl.
*E04B 1/348* (2006.01)
*E04B 1/24* (2006.01)
*E04H 5/02* (2006.01)

(52) U.S. Cl.
CPC ..... *E04B 1/3483* (2013.01); *E04B 1/2403* (2013.01); *E04H 5/02* (2013.01); *E04B 2001/2415* (2013.01); *E04B 2001/246* (2013.01)

(58) Field of Classification Search
CPC ..... E04B 1/3483; E04B 1/2403; E04B 2001/2415; E04B 2001/246;
(Continued)

(56) References Cited

U.S. PATENT DOCUMENTS 2,499,498 A * 3/1950 Hammond, Jr. ..... E04H 1/005 414/277
3,638,380 A * 2/1972 Perri ..... E04B 1/34807 52/79.12

(Continued)

FOREIGN PATENT DOCUMENTS

JP S61-053963 A 3/1986
JP H105-060342 A 3/1993

(Continued)

*Primary Examiner* — Brian E Glessner
*Assistant Examiner* — Adam G Barlow
(74) *Attorney, Agent, or Firm* — Chiesa Shahinian & Giantomasi PC

(57) ABSTRACT

A plant configuring module is created that includes a frame body having a lower frame member of a rectangular shape, an upper frame member having the same shape as the lower frame member, and a column member that couples the upper frame member and the lower frame member, and a plant element arranged inside the frame body, the column member being formed with a projecting column portion that projects out from one side or both sides of the lower frame member and the upper frame member, and a flange plate for bonding being arranged at a distal end portion of the projecting column portion; the plant configuring modules are stacked by a predetermined number of stages at a plant construction place; two overlapping flange portions of the overlapped plant configuring modules are coupled; and the plant configuring modules adjacent in a horizontal direction are coupled with a connecting beam.

13 Claims, 9 Drawing Sheets

(58) Field of Classification Search
CPC ..... E04B 1/34815; E04B 1/34823; E04B 1/34807; E04F 21/18; E04F 13/0885; E04H 5/02; E04H 1/04; E04H 1/1205
USPC ..... 52/79.1, 79.3, 79.6, 79.11–79.13
See application file for complete search history.

(56) References Cited

U.S. PATENT DOCUMENTS 3,824,750 A * 7/1974 Antoniou ..... E04B 1/3483 52/223.4
3,881,571 A * 5/1975 Moulton ..... E04G 1/14 182/178.5
4,136,492 A * 1/1979 Willingham ..... E04B 1/34823 52/79.14
4,299,065 A * 11/1981 Fairgrieve ..... E04B 1/3483 52/79.11
4,545,159 A * 10/1985 Rizk ..... E04B 1/3483 52/79.9
4,833,841 A * 5/1989 Ellington, III ..... E04B 1/3483 52/690
5,243,794 A * 9/1993 Pikor ..... E04H 13/006 52/79.9
8,769,886 B2 * 7/2014 Ohnishi ..... E04B 1/3483 52/638
8,854,809 B2 * 10/2014 Neumann ..... H05K 7/2049 52/234
9,010,037 B1 * 4/2015 Gonzalez ..... E04C 5/166 52/125.4
9,441,359 B1 * 9/2016 Hsieh ..... E04B 1/3483
10,280,608 B2 * 5/2019 Ledoux ..... B65D 90/0006
10,526,781 B2 * 1/2020 Lestini ..... E04B 1/1912
10,907,342 B1 * 2/2021 Parkhouse ..... F16B 7/182
11,130,625 B2 * 9/2021 Ledoux ..... B65D 88/027
2005/0241242 A1 * 11/2005 De La Marche ... E04B 1/34815 52/79.1
2008/0134589 A1 * 6/2008 Abrams ..... E04B 1/34807 52/79.1
2009/0223153 A1 * 9/2009 MacGregor ..... E04B 1/3483 52/284
2011/0016802 A1 * 1/2011 Wallance ..... E04B 1/34384 52/79.9
2011/0173907 A1 * 7/2011 Katsalidis ..... E04C 3/30 52/741.1
2012/0066985 A1 * 3/2012 Bachorz ..... E04H 5/04 52/79.9
2012/0073214 A1 * 3/2012 Sie ..... E04F 17/005 52/274
2013/0055671 A1 * 3/2013 Bruce ..... E04C 3/08 52/645
2013/0305629 A1 * 11/2013 Stephenson ..... E04H 1/005 52/79.9
2015/0082713 A1 * 3/2015 Stanton ..... E05C 3/045 52/745.02
2016/0017609 A1 * 1/2016 Bottin ..... E04H 1/005 52/302.1
2016/0160515 A1 * 6/2016 Wallance ..... E04F 10/10 52/745.02
2016/0168844 A1 * 6/2016 Lago De Carvalho ..... E04B 1/34815 52/79.5
2018/0187444 A1 * 7/2018 Klein ..... E04B 1/943
2018/0347175 A1 12/2018 Anderson et al.
2019/0153720 A1 * 5/2019 Bonlin ..... E04B 1/34317
2019/0257073 A1 * 8/2019 Ledoux ..... B65D 88/027
2020/0208395 A1 * 7/2020 Hall ..... E04B 1/19
2020/0251803 A1 * 8/2020 Dominguez ..... E04B 1/3483
2022/0084391 A1 * 3/2022 Cui ..... B62D 33/046
2022/0112707 A1 * 4/2022 Cho ..... E04C 3/04

FOREIGN PATENT DOCUMENTS

JP H07-139152 A 5/1995
JP 2008190262 A * 8/2008
JP 2011-163054 A 8/2011
JP 2012-219527 A 11/2012
JP 2016-156194 A 9/2016
WO 2018/222508 A1 12/2018

* cited by examiner

CONSTRUCTION METHOD FOR PLANT FACILITY AND PLANT CONFIGURING MODULE

TECHNICAL FIELD

The present invention relates to a construction method for a plant facility and a plant configuring module used for the same.

BACKGROUND ART

Conventionally, in order to easily and rapidly construct a plant facility, that which manufactures a module in which a plant facility is arranged within a frame body of a container size, conveys the module to a construction place, and assembles the same has been proposed.

Patent document 1 describes a plant facility including a plant main body, and a structure that forms the outer frame and supports the plant main body, where the outer shape of the structure is a container size.

Further, Patent document 2 describes a plant including a facility main body built by sequentially assembling a plurality of units, and a corridor arranged at the periphery of the facility main body, where components of the corridor are incorporated in the unit in advance.

Moreover, Patent document 3 describes a plant configuring member in which a plurality of parts configuring a plant are connected and unitized in advance, the unit being accommodated and arranged within a supporting steel so that the unit is configured to be attachable to the plant by means of the entire supporting steel, and a part of the supporting steel being set as a part of the plant configuring steel after the plant is configured.

PRIOR ART REFERENCES

Patent Documents

[Patent document 1] Japanese Laid-Open Patent Publication No. 2011-163054

[Patent document 2] Japanese Laid-Open Patent Publication No. 07-139152

[Patent document 3] Japanese Laid-Open Patent Publication No. 61-53963

DISCLOSURE OF THE INVENTION

Problems to be Solved by the Invention

When building a plant using such a module, a pipe space for arranging pipes and control lines, and a passage for operators and inspectors to move need to be installed between modules, which are overlapped vertically or lined in a horizontal direction. However, in the conventional technique, the arrangement of the pipe space and the passage is not taken into consideration, and a step for separately providing a pipe space and a passage is required.

In the invention described in Patent document 2, the passage is incorporated in the unit (module), but the inside of the unit becomes narrower due to the construction of the passage, and the degree of freedom in the arrangement of plant elements lowers.

The present invention has been made in view of the above problems, and aims to provide a construction method for a plant facility and a plant configuring module capable of ensuring a pipe space and an arrangement space for a passage by simply assembling plant configuring modules at a plant construction place, and completing the plant facility in a short period of time without affecting the arrangement of plant elements arranged within the plant configuring module.

Means for Solving the Problems

An invention described in claim 1 for solving the above problems relates to a construction method of a plant facility including the steps of creating a plant configuring module including a frame body with a lower frame member having a rectangular shape, an upper frame member having the same shape as the lower frame member, and a column member that couples the upper frame member and the lower frame member, and a plant element arranged inside the frame body, the column member being formed with a projecting column portion that projects out from one side or both sides of the lower frame member and the upper frame member, and a flange plate for bonding being arranged at a distal end portion of the projecting column portion; stacking the plant configuring module by a predetermined number of stages at a plant construction place; and coupling two overlapped flange portions of the overlapped plant configuring modules.

According to the present invention, when constructing a plant facility, a plant configuring module is created that includes a frame body with a lower frame member having a rectangular shape, an upper frame member having the same shape as the lower frame member, and a column member that couples the upper frame member and the lower frame member, and a plant element arranged inside the frame body, the column member being formed with a projecting column portion that projects out from one side or both sides of the lower frame member and the upper frame member, and a flange plate for bonding being arranged at a distal end portion of the projecting column portion; the plant configuring module is stacked by a predetermined number of stages at a plant construction place; and two overlapped flange portions of the overlapped plant configuring modules are coupled.

Thus, the assembly can be carried out by simply stacking the plant configuring modules and connecting the flange plates, where a pass-through region where a pipe space can be provided is formed by two projecting column portions in the stacked upper and lower frame bodies.

Thus, a special construction for forming the pipe space is not necessary, and the construction period can be shortened. Furthermore, the upper frame member of the overlapped lower plant configuring module and the lower frame member of the upper plant configuring module are not arranged in a directly overlapping manner, and there is no waste nor roughness in the molding by a plurality of frame bodies of a plurality of assembled plant configuring modules.

Similarly, an invention described in claim 2 relates to a construction method of a plant facility including the steps of creating a plant configuring module including a frame body with a lower frame member having a rectangular shape, an upper frame member having the same shape as the lower frame member, and a column member that couples the upper frame member and the lower frame member, and a plant element arranged inside the frame body, the upper frame member and the lower frame member of the plant configuring module adjacently arranged by a predetermined dimension including a connecting portion that connects a connecting beam arranged between the plant configuring modules on the upper frame member and the lower frame member; arranging the plant configuring modules by a predetermined number to be spaced apart and lined by a predetermined dimension at a plant construction place; and arranging a connecting beam having the predetermined dimension between the frame bodies of the plant configuring modules that are arranged, and coupling the frame body and the connecting beam of the plant configuring module.

According to the present invention, when constructing a plant facility, a plant configuring module is created that includes a frame body with a lower frame member having a rectangular shape, an upper frame member having the same shape as the lower frame member, and a column member that couples the upper frame member and the lower frame member, and a plant element arranged inside the frame body, the upper frame member and the lower frame member of the plant configuring module adjacently arranged by a predetermined dimension including a connecting portion that connects a connecting beam arranged between the plant configuring modules; the plant configuring modules are arranged by a predetermined number to be spaced apart and lined by a predetermined dimension at a plant construction place; and a connecting beam having the predetermined dimension is arranged between the frame bodies of the plant configuring modules that are arranged to couple the frame body and the connecting beam of the plant configuring module.

Thus, the assembly can be carried out by simply lining the plant configuring modules and connecting the frame bodies with the connecting beam, and a pass-through region where a passage can be provided is formed by the connecting beam.

Thus, a special construction for forming the passage is not necessary, and the construction period can be shortened. Furthermore, the plurality of column members of the plurality of plant configuring modules arranged adjacent to each other are not arranged close together, and there is no waste nor roughness in the molding by a plurality of frame bodies of a plurality of assembled plant configuring modules.

Similarly, an invention described in claim 3 relates to the construction method of the plant facility according to claim 1, further including the step of arranging a predetermined member with a pass-through region formed in a horizontal direction by the projecting column portion between the plant configuring modules as a piping and wiring space.

According to the present invention, a predetermined member can be arranged with the pass-through region formed in the horizontal direction by the projecting column portions between the plant configuring modules as the piping and wiring space. Thus, the piping and wiring can be easily carried out in the formed pass-through region by simply stacking and connecting the plant configuring modules.

Similarly, an invention described in claim 4 relates to the construction method of the plant facility according to claim 2, further including the step of arranging a predetermined member with a pass-through region formed in a horizontal direction by the connecting beam between the plant configuring modules as a passage.

According to the present invention, a predetermined member can be arranged with the pass-through region formed in the horizontal direction by the connecting beam between the plant configuring modules as the passage. Thus, the passage can be easily formed in the formed pass-through region by lining the plant configuring modules and connecting with the coupling beam member.

Similarly, an invention described in claim 5 relates to a plant configuring module that includes a frame body with a lower frame member having a rectangular shape, an upper frame member having the same shape as the lower frame member, and a column member that couples the upper frame member and the lower frame member, and a plant element arranged inside the frame body, and that builds a plant facility constructed by combining a plurality of plant configuring modules; where the column member is formed with a projecting column portion that projects out from one side or both sides of the lower frame member and the upper frame member; and a flange plate for bonding is arranged at a distal end of the projecting column portion.

According to the present invention, when overlapping and assembling the frame bodies, the flange plates arranged at distal ends of the projecting column portions projecting out from the column member of the frame bodies of the two plant configuring modules are connected. Thus, the two plant configuring modules can be easily overlapped and connected. At this time, a pass-through region corresponding to the dimension of two projecting column portions can be formed between the overlapped frame bodies, which pass-through region can be used as a piping and wiring space.

Similarly, an invention described in claim 6 relates to the plant configuring module according to claim 5, where the upper frame member and the lower frame member include a connecting portion that connects a connecting beam arranged between the plant configuring modules adjacently arranged by a predetermined dimension.

According to the present invention, when lining and assembling the plant configuring modules, the connecting beam member is connected to the connecting portions of the frame bodies of the two plant configuring modules. Thus, the two plant configuring modules can be easily lined and connected. At tis time, a pass-through region corresponding to the dimension of the connecting beam can be formed between the adjacent frame bodies, and the pass-through region can be used as a passage space.

Similarly, an invention described in claim 7 relates to the plant configuring module according to claim 5, where a bolt hole is opened in the flange plate, and the plant configuring modules of the plants that are adjacently arranged are connectable with a bolt and a nut.

According to the present invention, a bolt hole is opened in the flange plate. Thus, the frame bodies of the overlapped plant configuring modules can be fixed with a bolt and a nut, and fire such as welding is not used.

Similarly, an invention according to claim 8 relates to the plant configuring module according to claim 5, where the plant element is arranged in a state of being bondable with the plant element arranged in the plant configuring module of the adjacently constructed plant facility.

According to the present invention, the plant element such as pump, tank, reactor and pipe is arranged in a state of being bondable with a plant element arranged in a plant configuring module of an adjacently constructed plant. Thus, the plant elements of the adjacent plant configuring modules can be easily installed in a state where the plant configuring modules are overlapped, lined and arranged, and the construction period can be shortened.

Similarly, an invention according to claim 9 relates to the plant configuring module according to claim 5, where the plant configuring module having the projecting column portion only on the upper frame member is arranged at the bottom of the plant facility.

According to the present invention, the plant configuring module having the projecting column portion only on the upper frame member is arranged at the bottom of the plant facility. Thus, the plant configuring module arranged at the bottom can be directly fixed to the base.

Similarly, an invention described in claim 10 relates to the plant configuring module according to claim 5, where the plant configuring module having the projecting column portion only on the lower frame member is arranged at the top of the plant facility.

According to the present invention, the plant configuring module having the projecting column portion only on the lower frame member is arranged at the top of the plant facility. Thus, the unnecessary projecting column portion is not exposed to the upper side of the frame body of the plant configuring module arranged at the top, and the quality of outer appearance can be enhanced.

Further, according to the present invention, the pipe space and the arrangement space for a passage can be ensured by simply assembling the modules at a plant construction place without affecting the plant element arranged in the module.

Similarly, an invention described in claim 11 relates to the plant configuring module according to claim 5, where the upper frame member includes a first member arranged at a predetermined height position along one of two intersecting directions in which a member configuring the lower frame member is arranged, and a second member arranged along the other of the two directions and arranged at a height position different from the first member.

According to the present invention, the first member and the second member constituting the lower frame member are arranged at different height positions. Thus, piping member such as pipe and duct to use in the plant can be mounted and arranged on each of the first member and the second member. Thus, when arranging the piping member and the like to be arranged in the first member and the second member in different directions that intersect each other, the piping member and the like to be arranged along the intersecting direction can be arranged without interference at different height positions.

Effect of the Invention

According to the construction method of the plant facility and the plant configuring module according to the present invention, the pipe space and the arrangement space for the passage can be ensured by simply assembling the plant configuring module at the plant construction place without affecting the arrangement of the plant elements arranged in the plant configuring module, and the plant facility can be completed in a short construction period.

According to the construction method of the plant facility described in claim 1, when constructing a plant facility, a plant configuring module is created that includes a frame body with a lower frame member having a rectangular shape, an upper frame member having the same shape as the lower frame member, and a column member that couples the upper frame member and the lower frame member, and a plant element arranged inside the frame body, the column member being formed with a projecting column portion that projects out from one side or both sides of the lower frame member and the upper frame member, and a flange plate for bonding being arranged at a distal end portion of the projecting column portion is created; the plant configuring module is stacked by a predetermined number of stages at a plant construction place; and two overlapped flange portions of the overlapped plant configuring modules are coupled.

Thus, the assembly can be carried out by simply stacking the plant configuring modules and connecting the flange plates, where a pass-through region where a pipe space can be provided is formed by two projecting column portions in the stacked upper and lower frame bodies.

Thus, a special construction for forming the pipe space is not necessary, and the construction period can be shortened. Furthermore, the upper frame member of the overlapped lower plant configuring module and the lower frame member of the upper plant configuring module are not arranged in a directly overlapping manner, and there is no waste nor roughness in the molding by a plurality of frame bodies of a plurality of assembled plant configuring modules.

According to the construction method of the plant facility described in claim 2, when constructing a plant facility, a plant configuring module is created that includes a frame body with a lower frame member having a rectangular shape, an upper frame member having the same shape as the lower frame member, and a column member that couples the upper frame member and the lower frame member, and a plant element arranged inside the frame body, the upper frame member and the lower frame member of the plant configuring module adjacently arranged by a predetermined dimension including a connecting portion that connects a connecting beam arranged between the plant configuring modules on the upper frame member and the lower frame member; the plant configuring modules are arranged by a predetermined number to be spaced apart and lined by a predetermined dimension at a plant construction place; and a connecting beam having the predetermined dimension is arranged between the frame bodies of the plant configuring modules arranged side by side to couple the frame body and the connecting beam of the plant configuring module.

Thus, the assembly can be carried out by simply lining the plant configuring modules and connecting the frame bodies with the connecting beam, and a pass-through region where a passage can be provided is formed by the connecting beam. Thus, a special construction for forming the work passage is not necessary, and the construction period can be shortened. Furthermore, the plurality of column members of the plurality of plant configuring modules arranged adjacent to each other are not arranged close together, and there is no waste nor roughness in the molding by a plurality of frame bodies of a plurality of assembled plant configuring modules.

According to the invention described in claim 3, a predetermined member can be arranged with the pass-through region formed in the horizontal direction by the projecting column portions between the plant configuring modules as the piping and wiring space. Thus, the piping and wiring can be easily carried out in the formed pass-through region by simply stacking and connecting the plant configuring modules.

Further, in the construction method of the conventional module type plant facility, the frame body configuring each unit was welded and connected at the plant construction site, or the connecting member was appropriately applied for connection and fixation to build the plant, and thus it was impossible to accurately perform the strength calculation of the module and the safety of the built plant could not be sufficiently verified in relation with the overweight of the plant element to provide. However, according to the construction method of the plant facility and the plant configuring module according to the present invention, the plant configuring module can be formed in the factory with the plant element provided in advance, and thus strength calculation and strength test can be performed at the module creating stage in the factory, and the safety of the plant to be built can be reliably ensured.

Further, since the plant configuring module can be formed in the factory with the plant element provided in advance, the schedule control of the plant construction can be easily carried out.

According to the invention described in claim 4, a predetermined member is arranged with the pass-through region formed in the horizontal direction by the connecting beam between the plant configuring modules as the passage. Thus, the passage can be easily formed in the formed pass-through region by arranging the plant configuring modules side by side and connecting with the coupling beam member.

According to the plant configuring module described in claim 5, when overlapping and assembling the frame bodies, the flange plates arranged at distal ends of the projecting column portions projecting out from the column member of the frame bodies of the two plant configuring modules are connected. Thus, the two plant configuring modules can be easily overlapped and connected. At this time, a pass-through region corresponding to the dimension of two projecting column portions can be formed between the overlapped frame bodies, which pass-through region can be used as a piping and wiring space.

According to the plant configuring module according to claim 6, when lining and assembling the plant configuring modules, the connecting beam member is connected to the connecting portions of the frame bodies of the two plant configuring modules. Thus, the two plant configuring modules can be easily lined and connected. At this time, a pass-through region corresponding to the dimension of the connecting beam can be formed between the adjacent frame bodies, and the pass-through region can be used as a passage space.

According to the plant configuring module described in claim 7, a bolt hole is opened in the flange plate. Thus, the frame bodies of the overlapped plant configuring modules can be fixed with a bolt and a nut, and fire such as welding is not used.

According to the plant configuring module described in claim 8, the plant element such as pump, tank, reactor and pipe is arranged in a state of being bondable with a plant element arranged in a plant configuring module of an adjacently constructed plant. Thus, the plant elements of the adjacent plant configuring modules can be easily installed in a state where the plant configuring modules are overlapped, lined and arranged, and the construction period can be shortened.

According to the plant configuring module described in claim 9, the plant configuring module having the projecting column portion only on the upper frame member is arranged at the bottom of the plant facility. Thus, the plant configuring module arranged at the bottom can be directly fixed to the base.

According to the plant configuring module described in claim 10, the plant configuring module having the projecting column portion only on the lower frame member is arranged at the top of the plant facility. Thus, the unnecessary projecting column portion is not exposed to the upper side of the frame body of the plant configuring module arranged at the top, and the quality of outer appearance can be enhanced.

According to the plant configuration module described in claim 11, the first member and the second member constituting the lower frame member are arranged at different height positions. Thus, piping member such as pipe and duct to use in the plant can be mounted and arranged on each of the first member and the second member. Thus, when arranging the piping member and the like to be arranged in the first member and the second member in different directions that intersect each other, the piping members to be arranged along the intersecting direction can be arranged without interference at different height positions.

BEST MODE FOR CARRYING OUT THE INVENTION

A construction method for a plant facility and a plant configuring module according to a mode for carrying out the present invention will be described.

First, the plant configuring module according to the present embodiment, and a plant facility constructed by combining a plurality of such plant configuring modules will be described.

Figure 5:
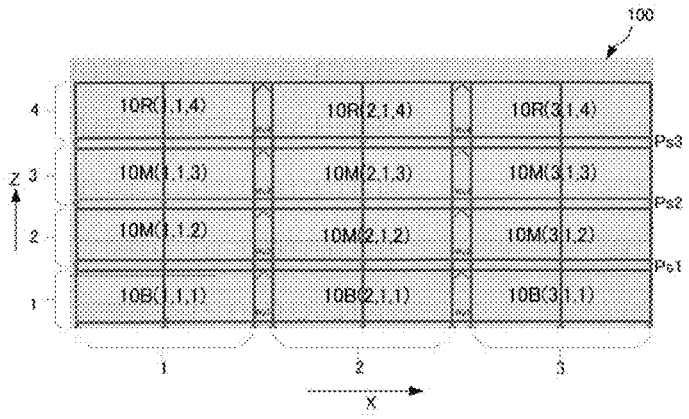
FIGS. 5(*a*), (*b*) and (*c*) shows a plant facility constructed by assembling the plant configuring modules, where (a) is a front view, (b) is a side view, and (c) is a plan view.
Figure 5:
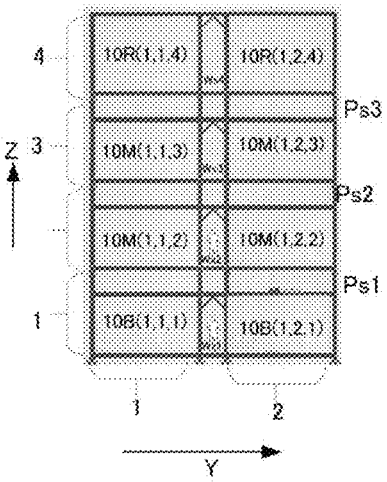
Figure 5C:
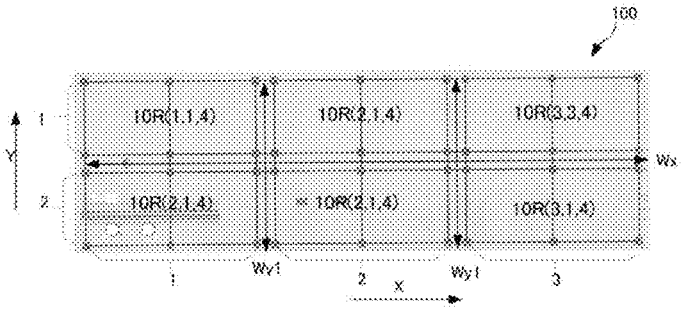

FIGS. 5(*a*), (*b*) and (*c*) shows a plant facility constructed by assembling the plant configuring modules, where (a) is a front view, (b) is a side view, and (c) is a plan view. As shown in FIGS. 5(*a*), (*b*) and (*c*), a plant facility 100 is configured by installing and bonding a total of 24 plant configuring modules in the horizontal direction (X direction, Y direction) of the installing place, that is, three in the X direction, two in the Y direction, and four stages in a height direction (Z direction).

In the present embodiment, as a plant configuring module, a bottom stage module 10B is installed at the bottom, a middle stage module 10M is installed at a second stage and a third stage, and a top stage module 10R is installed at a top position of the plant facility 100. The bottom stage module 10B, the middle stage module 10M, and the top stage module 10R have necessary plant elements, for example, plant elements 61, 62, 63, 64, . . . such as tank, pump, reactor, pipe, and the like arranged within a frame body 10 configured with an H-type steel material. Each plant element is configured and arranged so as to be bonded with the plant elements arranged in the plant configuring modules adjacent in a vertical direction and a planar direction can be bonded.

The bottom stage module 10B, the middle stage module 10M, and the top stage module 10R have a size that enable container transportation on water and on land. For example, the size is to fit in 4 m×5 m×12 m.

Figure 2:
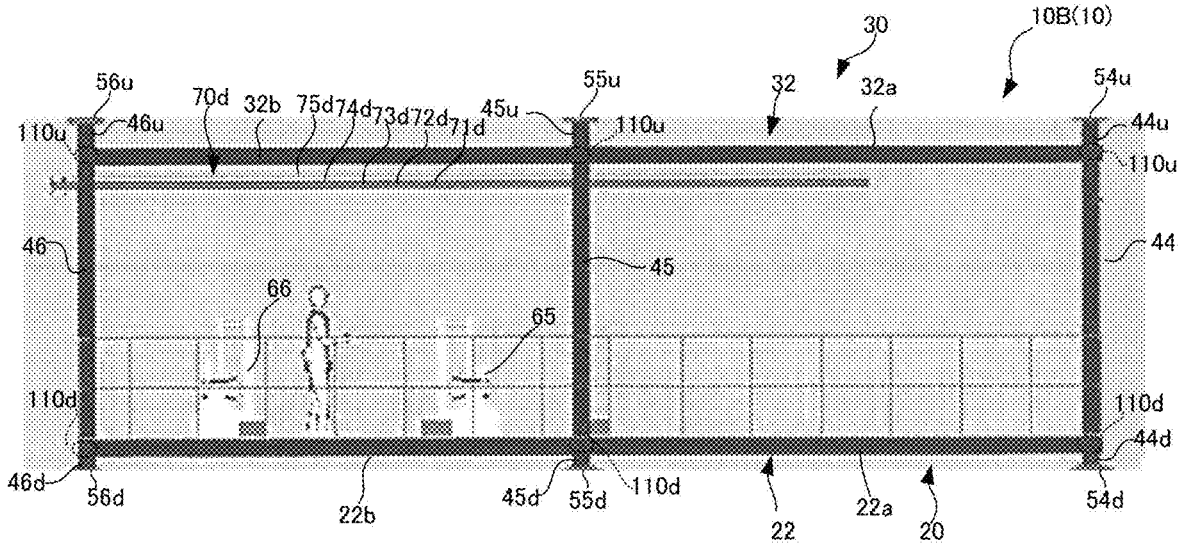
FIGS. 2(*a*) and (*b*) shows the bottom stage module, where (a) is a front view and (b) is a side view.
Figure 2:
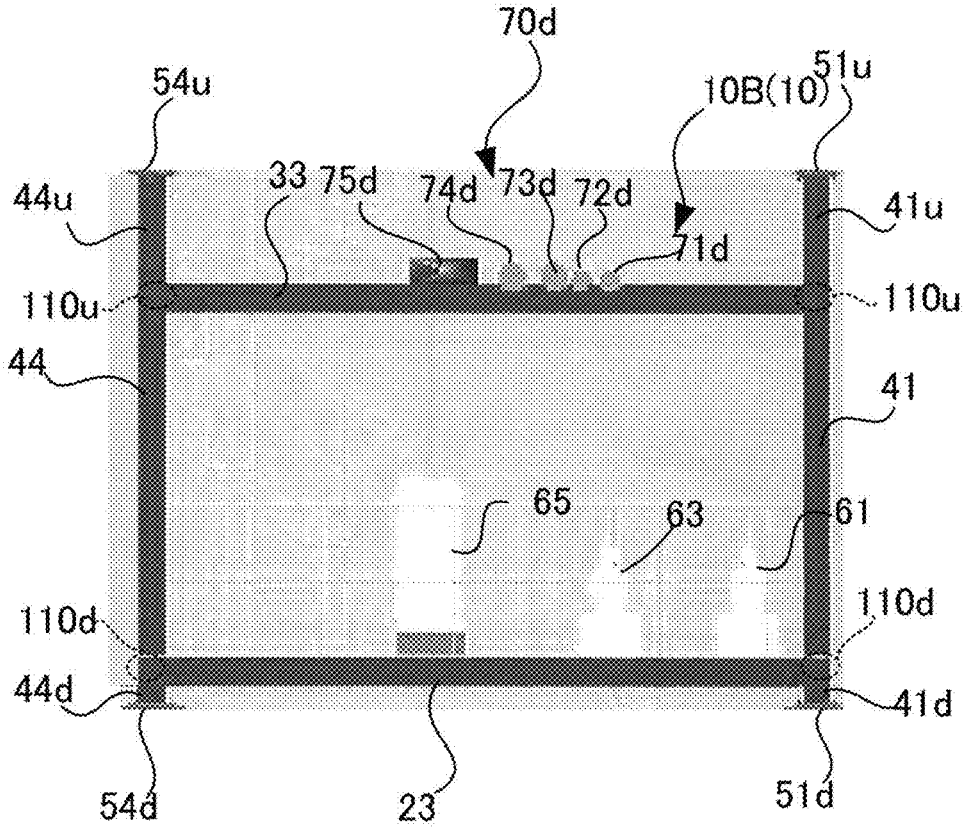

In this example, the plant facility 100 has six bottom stage modules 10B in the first stage, six middle stage modules 10M in the second stage, six middle stage modules 10M in the third stage, and six top stage modules 10R in the fourth stage. In FIGS. 2(*a*) and (*b*), numbers are given in the X direction, Y direction, and Z direction, and a coordinate of (X, Y, Z) is given to the bottom stage module 10B, the middle stage module 10M, and the top stage module 10R.

Figure 1:
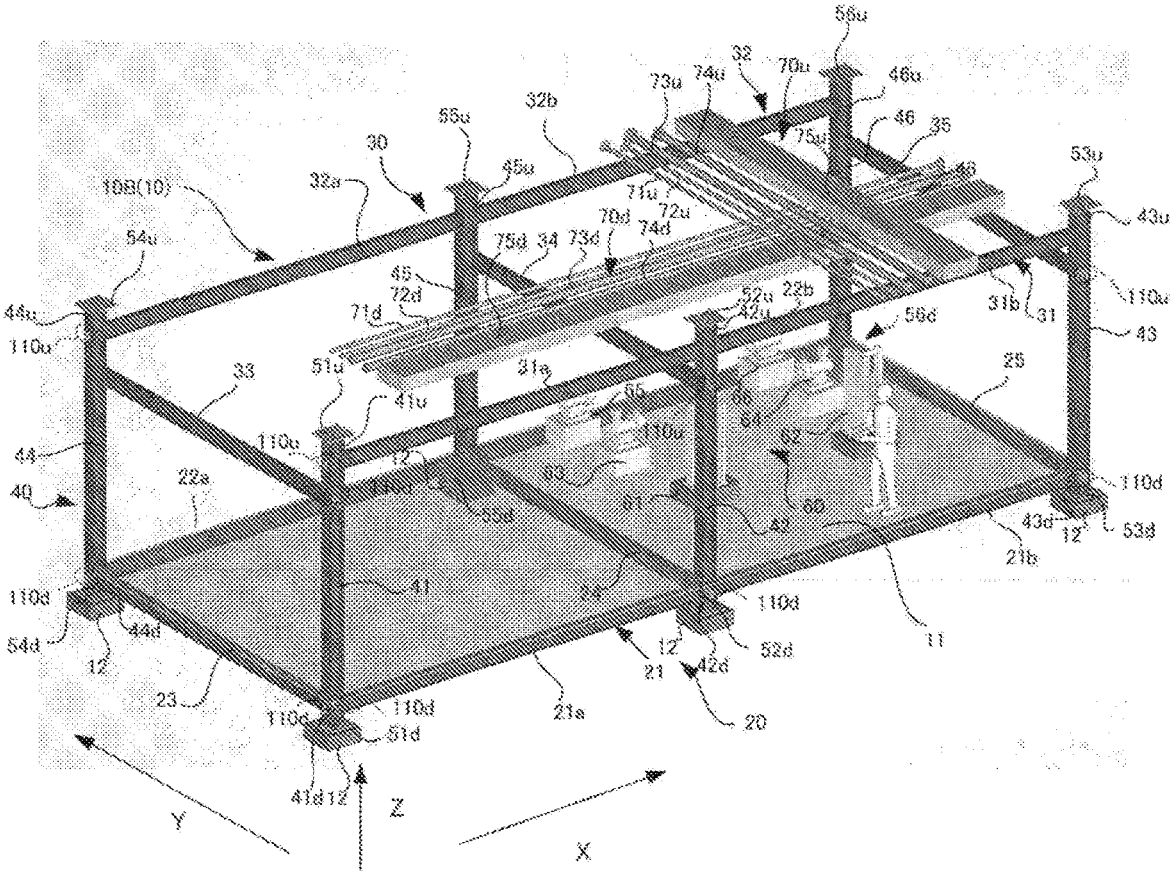
FIG. 1 is a perspective view showing a bottom stage module of a plant configuring module according to an embodiment of the present invention.

Next, a configuration of the plant configuring module of each stage will be described. FIG. 1 is a perspective view showing the bottom stage module of the plant configuring module according to an embodiment of the present invention, and FIGS. 2(*a*) and (*b*) shows the bottom stage module, where (a) is a front view and (b) is a side view.

The bottom stage module 10B is arranged on a base 12. Further, the bottom stage module 10B is configured by arranging a floor plate 11 in the frame body 10 formed with the H-type steel material, and arranging plant elements 61, 62, 63, 64, 65, 66 on the floor plate 11. Each of the plant elements to be arranged are set depending on which position in the plant facility 100 each plant element is arranged.

In the present example, the frame body 10 is configured by connecting a lower frame member 20, an upper frame member 30, and a column member 40. This connection selects welding, high-tension bolt and nut, and the like, as necessary.

The lower frame member 20 is configured by connecting two long side members 21, 22 extending in the X direction in the figure, and three short side members 23, 24, 25 extending in the Y direction in the figure so as to form a rectangle as a whole. In the present embodiment, the long side member 21 is configured by connecting two short members 21*a*, 21*b*. Similarly, the long side member 22 is configured by connecting two short members 22*a*, 22*b*.

The short side members 23, 25 are connected to both ends of the long side members 21, 22, respectively. The short side member 24 is connected to a central position of the long side members 21, 22, that is, a connecting portion of the short members 21*a*, 21*b* and a connecting portion of the short members 22*a*, 22*b*.

The upper frame member 30 includes two long side members 31, 32, which are first members, arranged at a predetermined height position along the X direction, which is one of the two directions of X and Y in which the long side members 21, 22 and the short side members 23, 24, 25 of the lower frame member 20 are arranged, and three short side members 33, 34, 35, which are second beam members, arranged along the Y direction which is the other one of the two directions.

The upper frame member 30 is configured by two long side members 31, 32, which are first members, extending in the X direction, and three short side members 33, 34, 35, which are second members. The short side members 33, 34, 35 are arranged to be located on the lower side of the long side members 31, 32. The short side members 33, 34, 35 can be arranged at the same position as or on the upper side of the long side members 31, 32.

The long side member 31 is configured by connecting two short members 31*a*, 31*b*. Similarly, the long side member 32 is configured by connecting two short members 32*a*, 32*b*. The short side member 33 is arranged between a column material 41 and a column material 44, to be described later, the short side member 34 is arranged between a column material 42 and a column material 45, and the short side member is arranged between a column material 43 and a column material 46.

The column member 40 is configured by six column materials 41, 42, 43, 44, 45, and 46. The column materials 41, 43, 44, and 46 couple the four corners of the lower frame member 20 and the upper frame member 30. Further, the column material 42 is coupled to a central position of the long side member 21 and the long side member 31, that is a connecting portion of the short members 21*a*, 21*b*, and a connecting portion of the short members 31*a*, 31*b*. Similarly, the column material 45 is coupled to a central position of the long side member 22 and the long side member 32, that is a connecting portion of the short members 22*a*, 22*b*, and a connecting portion of the short members 32*a*, 32*b*.

On an upper side from the upper frame member 30 of the column portions 41, 42, 43, 44, 45, and 46, upper projecting column portions 41*u*, 42*u*, 43*u*, 44*u*, 45*u*, and 46*u*, which are projecting column portions projecting toward the upper side from the upper frame member 30, are formed. Further, on the distal end portions of such upper projecting column portions 41*u*, 42*u*, 43*u*, 44*u*, 45*u*, and 46*u*, flange plates 51*u*, 52*u*, 53*u*, 54*u*, 55*u*, and 56*u* or flange portions for bonding with the middle stage module 10M arranged on the upper stage are connected. The flange plates 51*u*, 52*u*, 53*u*, 54*u*, 55*u*, and 56*u* are formed with a plurality of bolt holes for inserting bolts.

On a lower side from the upper frame member 30 of the column materials 41, 42, 43, 44, 45, and 46, lower projecting column portions 41*d*, 42*d*, 43*d*, 44*d*, 45*d*, and 46*d* are arranged in a projecting manner. To such lower projecting column portions 41*d*, 42*d*, 43*d*, 44*d*, and 45*d*, flange plates 51*d*, 52*d*, 53*d*, 54*d*, 55*d*, and 56*d* or flange portions for connecting with the base 12 are connected. The flange plates 51*d*, 52*d*, 53*d*, 54*d*, 55*d*, and 56*d* are formed with a plurality of bolt holes for inserting bolts.

In the bottom stage module 10B, the lower projecting column portions 41*d*, 42*d*, 43*d*, 44*d*, 45*d*, and 46*d* which are projecting column portions projecting toward the lower side from the lower frame member 20 of the column materials 41, 42, 43, 44, 45 and 46 are formed, but the flange plates 51*d* to 56*d* can be arranged without forming the upper projecting column portions.

In the present example, a piping and wiring member 70*d* is arranged along the X direction. The piping and wiring member 70*d* is arranged by being mounted on the short side members 33, 34, and 35. Further, in the present example, a piping and wiring member 70*u* is arranged along the Y direction. The piping and wiring member 70*u* is arranged by being mounted on the long side members 31 and 32.

The piping and wiring members 70*d*, 70*u* can be arranged with a pass-through region formed by the upper projecting column portions 41*u*, 42*u*, 43*u*, 44*u*, 45*u*, and 46*u* of the bottom stage module 10B and the lower projecting column portions 41*d*, 42*d*, 43*d*, 44*d*, 45*d*, and 46*d* of the middle stage module 10M arranged on the upper stage as a piping and wiring space (pipe space) Ps.

Since the long side members 31, 32 and the short side members 33, 34, 35 are arranged at different height positions, even if the piping and wiring members 70*d*, 70*u* are arranged in an intersecting direction, they can be prevented from interfering with each other. The piping and wiring member 70*d* includes pipes 71*d*, 72*d*, 73*d*, 74*d*, and a duct

75*d*, and the piping and wiring member 70*u* includes pipes 71*u*, 72*u*, 73*u*, 74*u*, and a duct 75*u*.

Figure 8:
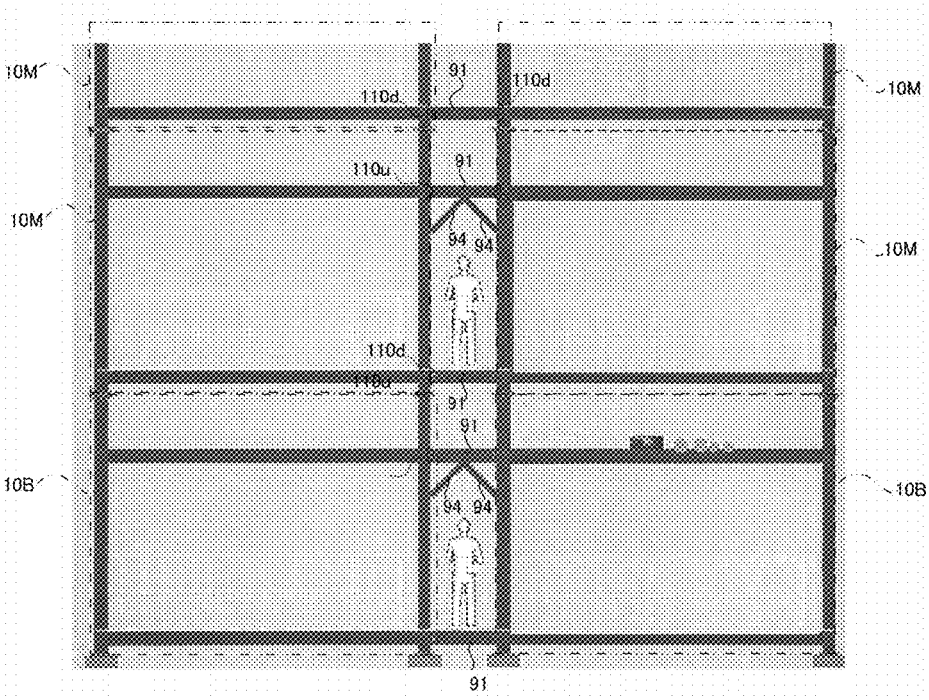
FIGS. 8(*a*) and (*b*) shows an arrangement state of the connecting beam in a state where the plant configuring modules are lined, where (a) is a partial side of the plant facility and (b) is a partial front view of the plant facility.
Figure 8:
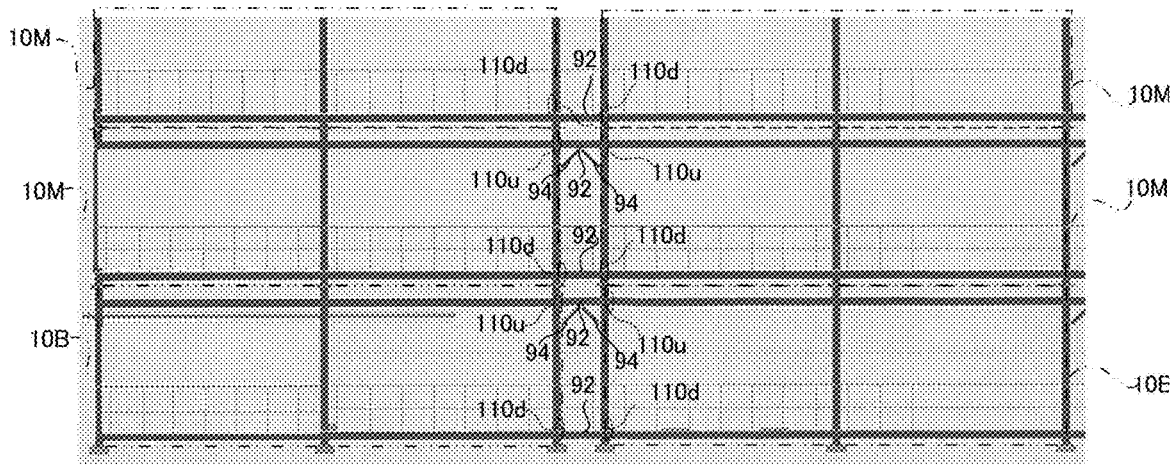

Further, in the bottom stage module 10B, connecting portions 110*u*, 110*d* for connecting another bottom stage module 10B also adjacently arranged in the plane and connecting beam 91, 92 (see FIGS. 8(*a*) and (*b*)) are formed at both ends and a central portion (arranging place of the column material 42) of the long side members 21, 22 configuring the lower frame member 20.

Figure 9:
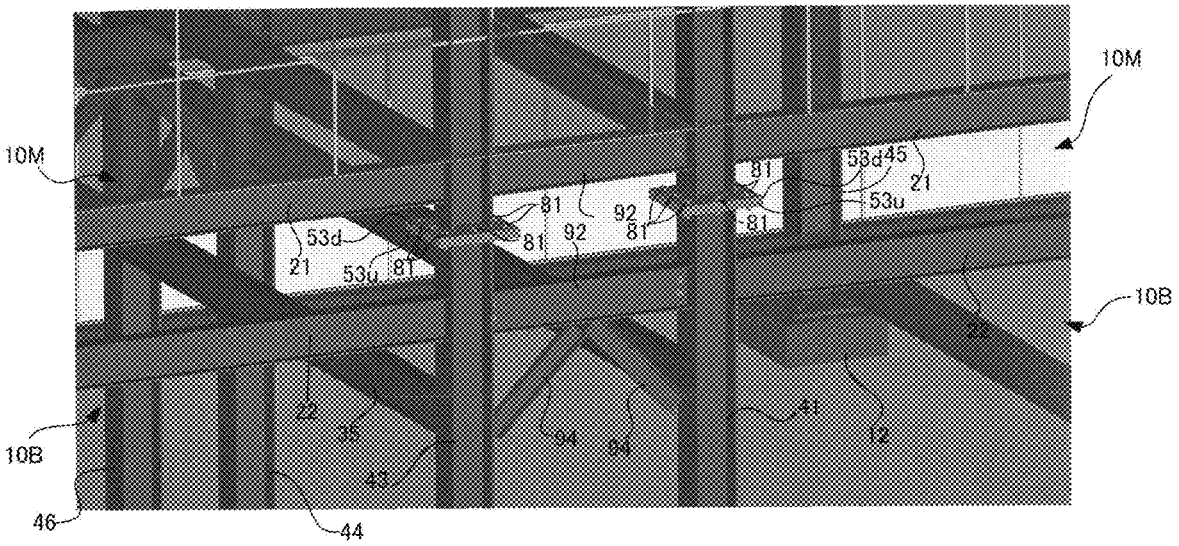
FIG. 9 is a perspective view showing a connected state of each plant configuring module in a state where a plurality of plant configuring modules are assembled for construction.

As shown in FIGS. 8 and 9, the connecting beam 91, 92 are obtained by securely attaching a flange plate with a bolt hole to both ends of the H-type steel, where bolt holes corresponding to the bolt holes of the connecting beam 91, 92 are opened in the connecting portions 110*u*, 110*d*.

Similarly, as shown in FIGS. 2(*a*) and (*b*), the connecting portion 110*u* for connecting another bottom stage module 10B also adjacently arranged in the plane and the connecting beam 91, 92 (see FIGS. 8(*a*) and (*b*)) is formed at both ends and a central portion (arranging place of the column material 42) of the long side members 31, 32 configuring the upper frame member 30.

Figure 3:
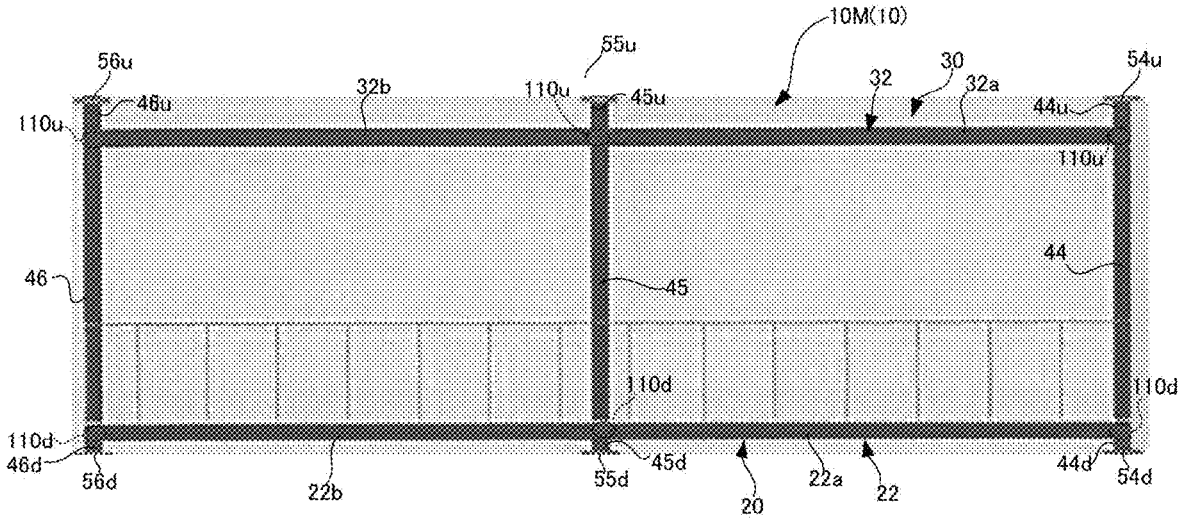
FIGS. 3(*a*) and (*b*) shows a middle stage module of the plant configuring module according to the embodiment of the present invention, where (a) is a front view and (b) is a side view.
Figure 3:
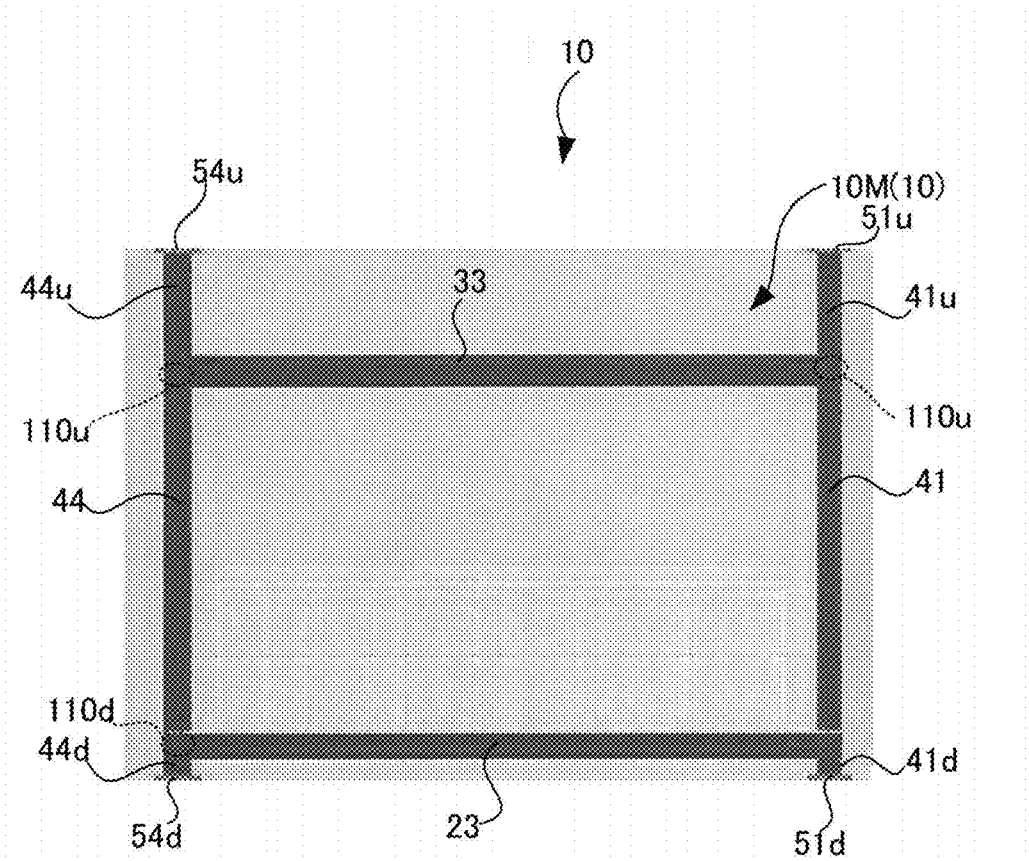

Next, the middle stage module 10M will be described. FIGS. 3(*a*) and (*b*) shows a middle stage module of the plant configuring module according to the embodiment of the present invention, where (a) is a front view and (b) is a side view. The middle stage module 10M basically has the same structure as the bottom stage module 10B descried above.

Figure 4:
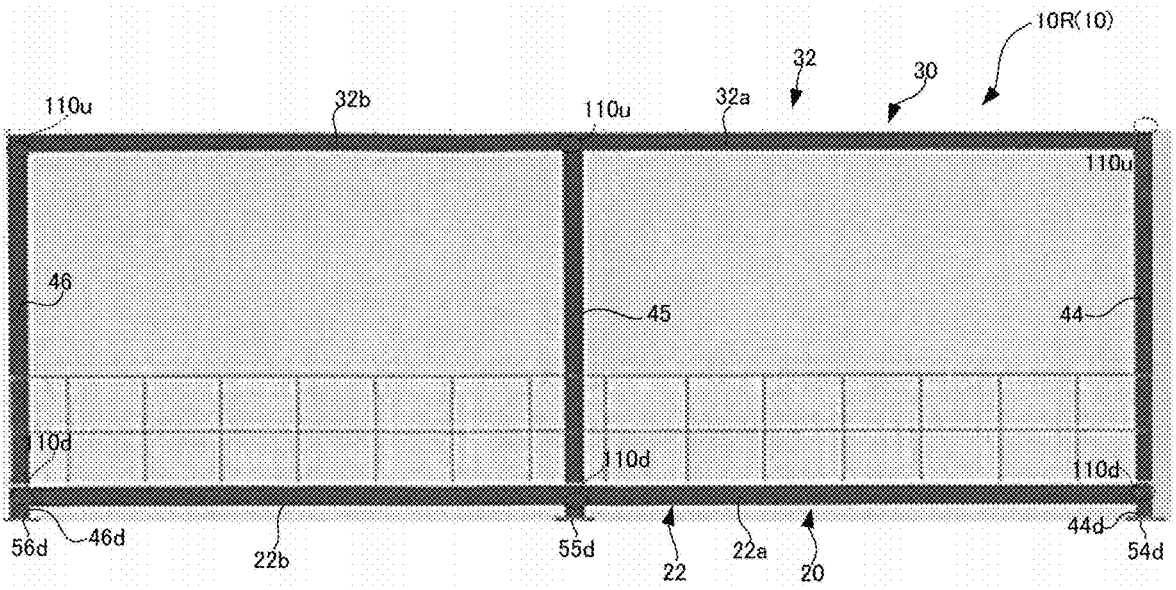
FIGS. 4(*a*) and (*b*) shows a top stage module 10R of the plant configuring module according to the embodiment of the present invention, where (a) is a front view and (b) is a side view.
Figure 4:
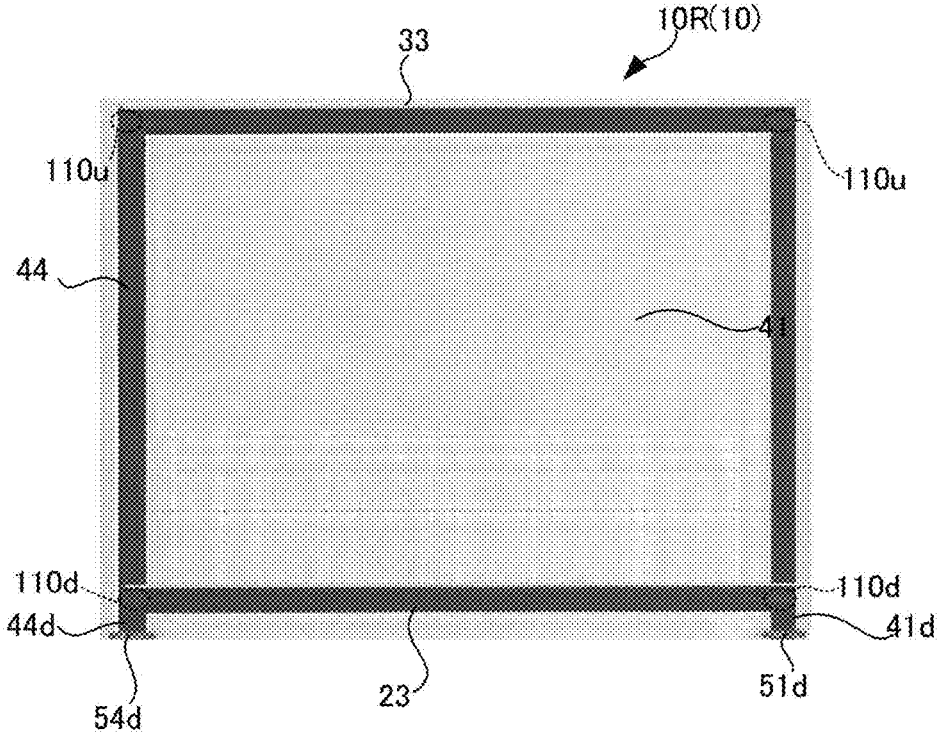

Next, the top stage module 10R will be described. FIGS. 4(*a*) and (*b*) shows the top stage module 10R of the plant configuring module according to the embodiment of the present invention, where (a) is a front view and (b) is a side view.

The difference with the middle stage module 10M described above is that a projecting column portion projecting upward is not provided at the portion above the upper frame member 30 of each column material 41, 42, 43, 44, 45, and 46. Other components are the same as the middle stage module 10M.

Facilities such as handrails, stairs and the like can be provided on the bottom stage module 10B, the middle stage module 10M, and the top stage module 10R, as necessary.

Figure 6:
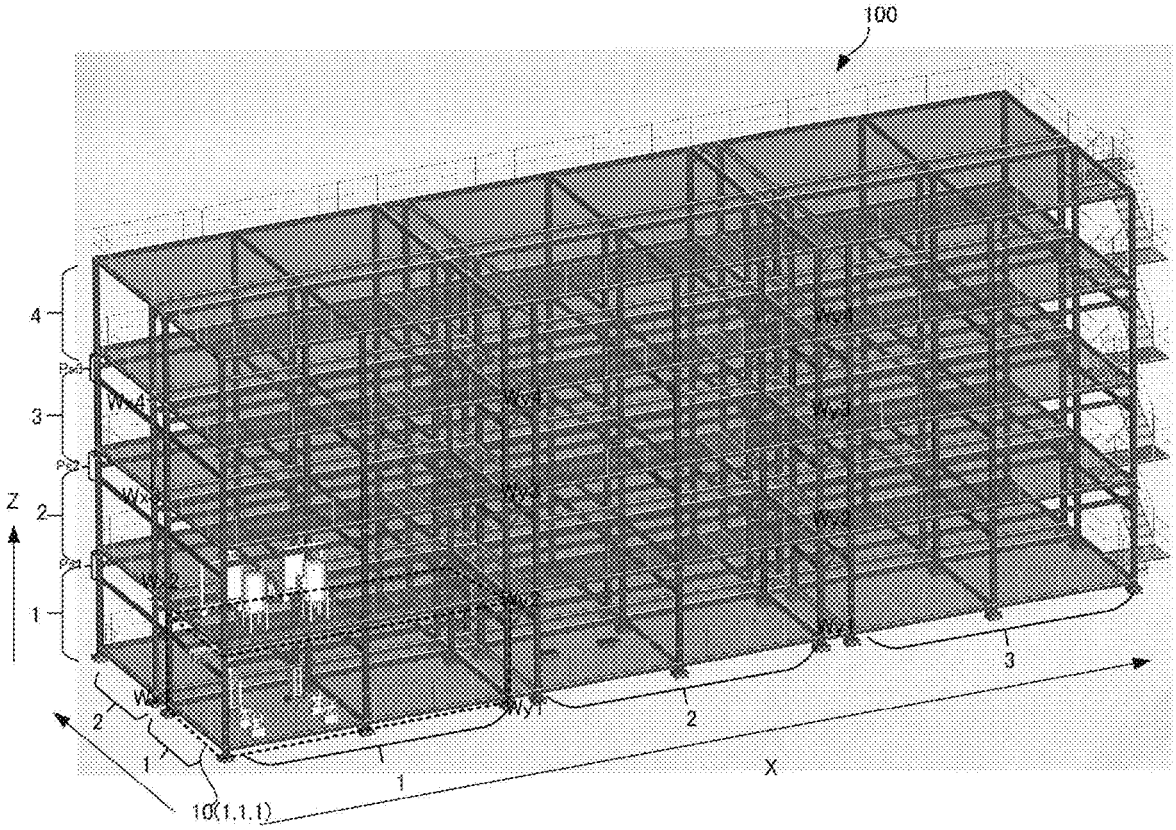
FIG. 6 is a perspective view showing a plant facility constructed by assembling the plant configuring modules.
Figure 7:
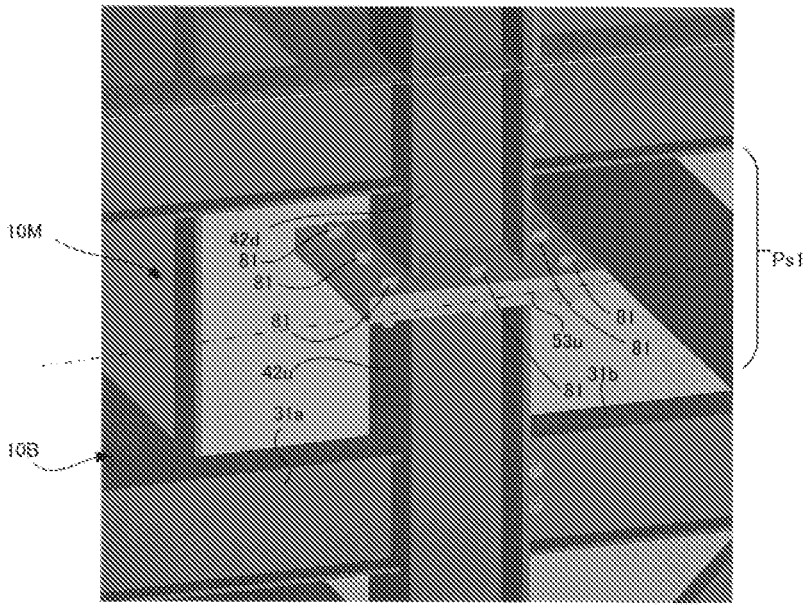
FIGS. 7(*a*) and (*b*) shows a connected state of the flange plate in a state where the plant configuring modules are overlapped, where (a) is an enlarged perspective view of portion A in FIG. 6 and (b) is an enlarged perspective view of portion B in FIG. 6.
Figure 7:
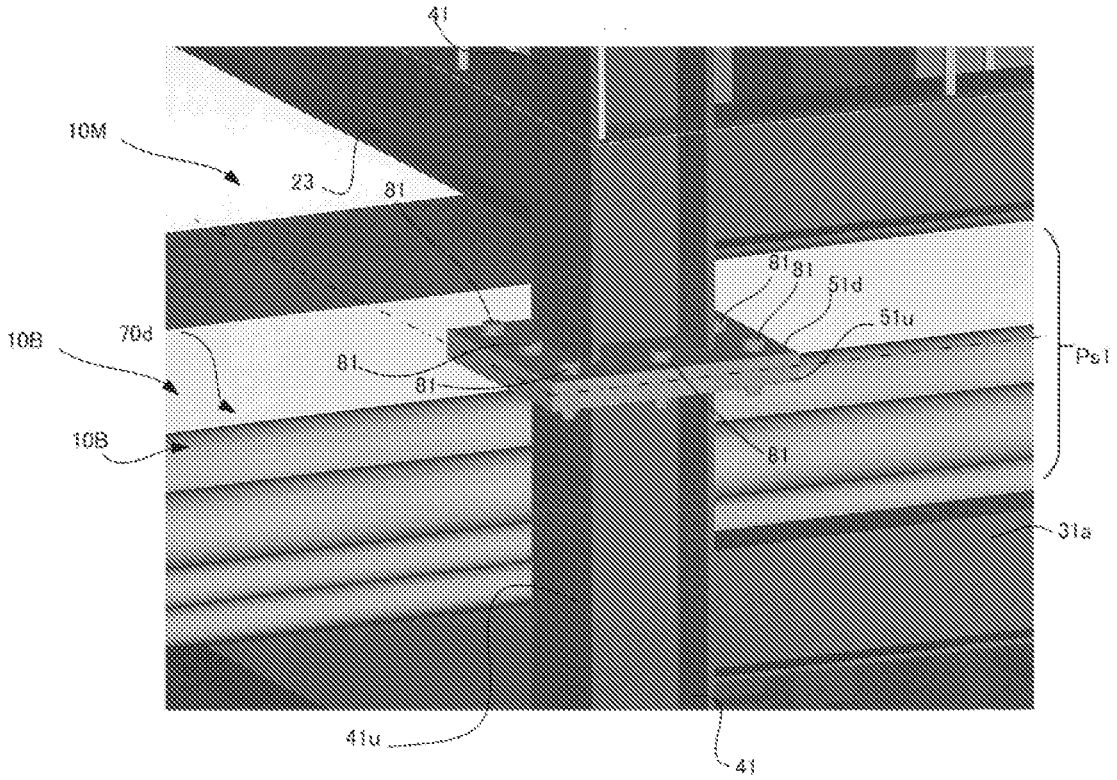

Next, a procedure for constructing the plant facility 100 using the plant configuring module according to the present embodiment will be described. FIGS. 5(*a*), (*b*) and (*c*) shows the plant facility constructed by assembling the plant configuring modules, where (a) is a front view, (b) is a side view, and (c) is a plan view; FIG. 6 is a perspective view showing the plant facility constructed by assembling the plant configuring modules; FIGS. 7(*a*) and (*b*) shows a connected state of the flange plate in a state where the plant configuring modules are overlapped, where (a) is an enlarged perspective view of portion A in FIG. 6 and (b) is an enlarged perspective view of portion B in FIG. 6; FIGS. 8(*a*) and (*b*) shows an arrangement state of the connecting beam in a state where the plant configuring modules are lined, where (a) is a partial side view of the plant facility and (b) is a partial front view of the plant facility; and FIG. 9 is a perspective view showing a connected state of each plant configuring module in a state where a plurality of plant configuring modules are assembled for construction.

First, a predetermined bottom stage module 10B, middle stage module 10M, and top stage module 10R are created in a factory. Each of the bottom stage module 10B, the middle stage module 10M, and the top stage module 10R is arranged with the necessary plant elements 61, 62, 63, 64, . . . , and the strength calculation of the entire module is performed in advance and various tests such as pressure resistance test is performed. Since the strength calculation and various tests of the module can be performed in advance in the factory, the tests to be conducted at the site can be minimized, thus achieving cost reduction.

The completed bottom stage module 10B, middle stage module 10M, and top stage module 10R are then conveyed to the plant construction place. In the present embodiment, the dimensions of the bottom stage module 10B, the middle stage module 10M, and the top stage module 10R are sizes that can be container transported on water and land, and thus a special conveying means is not required. Thus, the conveyance cost can be reduced.

In the example shown in FIGS. 5 and 6, a total of 24, that is, six bottom stage modules 10B, twelve middle stage modules 10M, and six top stage modules 10R are arranged, as described above.

First, the bottom stage modules 10B to be the first stage are arranged on the base 12 at the constructing location at a predetermined interval, and the flange plates 51*d* to 56*d* of each bottom stage module 10B are bolted to the base. Then, as shown in FIG. 8(*b*), between each bottom stage modules 10B, the connecting beam 92 is arranged between the facing connecting portions 110*d*, 110*d* of the adjacent bottom stage modules 10B and fixed with a bolt and a nut. A high-tension bolt is used to securely attach the connecting beam 91, 92

After the construction of the bottom stage modules 10B of the first stage is finished, four middle stage modules 10M are installed on the upper stage of the four bottom stage modules 10B. At this time, as shown in FIGS. 7(*a*) and 7(*b*), the flange plates 51*d* to 56*d* installed on the lower projecting column portions 41*d* to 46*d* of the 10M mounted on the upper stage are brought into contact with the upper part of the flange plates 51*u* to 56*u* arranged in the upper projecting column portions 41*u* to 46*u* of the bottom stage module 10B of the lower stage. Then, as shown in FIGS. 7(*a*) and (*b*), the flange plates 51*u* to 56*u* and the flange plates 51*d* to 56*d* are fastened and fixed with the bolt 81. A high-tension bolt is used to securely attach each flange. Further, a diagonal member 94 for reinforcement is arranged between the connecting beam 91 and each column member.

In this state, the piping and wiring member 70 is arranged with the pass-through space formed by the upper projecting column portions 41*u* to 46*u* and the lower projecting column portions 41*d* to 46*d* between the bottom stage module 10B and the middle stage module 10M and the top stage module 10R as the pipe spaces Ps1 to Ps3, and the floor plate is installed and formed with the pass-through region formed with the connecting beam 91, 92 between the bottom stage module 10B, the middle stage module 10M and the top stage module 10R arranged side by side as passages Wx1 to Wx4, Wy1 to Wy4, as shown in FIG. 6. Further, facilities such as stairs are installed, as necessary.

The plant elements are then bonded after the assembly of all of the bottom stage modules 10B, the middle stage modules 10M, and the top stage modules 10R is finished, or while assembling the bottom stage modules 10B, the middle stage modules 10M, and the top stage modules 10R.

In the embodiment described above, the plant facility 100 uses a total of 24 plant configuring modules, that is three in the X direction, two in the Y direction and four stages in the height direction (Z direction), but a required number of plant configuring modules can be installed in each direction and height direction, as necessary.

Further, the dimensions and numbers of the long side member, the short side member, and the column member configuring the frame body of each plant configuring module can be appropriately changed.

Further, the installing order of each plant configuring module at the time of constructing the plant facility 100, and the order of construction of the piping and wiring to the pipe space as well as installation of the passage can be appropriately changed.

INDUSTRIAL APPLICABILITY

A construction method for a plant facility and a plant configuring module according to the present invention can ensure a pipe space and an arrangement space for a passage by simply assembling the plant configuring modules at the plant construction place without affecting the arrangement of the plant elements to be arranged in the plant configuring module, and thus have industrial applicability.

DESCRIPTION OF SYMBOLS

2 document
10 frame body
10B bottom stage module (plant configuring module)
10M middle stage module (plant configuring module)
10R top stage module (plant configuring module)
11 floor plate
12 base
20 lower frame member
21 long side member
21*a* short member
21*b* short member
22 long side member
22*a* short member
22*b* short member
23, 24, 25 short side member
30 upper frame member
31 long side member (first member)
31*a* short member
31*b* short member
32 long side member (first member)
32*a* short member
32*b* short member
33, 34, 35 short side member (second member)
40 column member
41, 42, 43, 44, 45, 46 column material
41*d*, 42*d*, 43*d*, 44*d*, 45*d*, 46*d* lower projecting column portion
41*u*, 42*u*, 43*u*, 44*u*, 45*u*, 46*u* upper projecting column portion
51*d*, 52*d*, 53*d*, 54*d*, 55*d*, 56*d* flange plate
51*u*, 52*u*, 53*u*, 54*u*, 55*u*, 56*u* flange plate
61, 62, 63, 64, 65, 66 plant element
70*d*, 70*u* piping and wiring member
71*d*, 72*d*, 73*d*, 74*d*, 71*u*, 72*u*, 73*u*, 74*u* pipe
75*d*, 75*d* duct
81 bolt
91, 92 connecting beam
94 diagonal member
100 plant facility
110*d*, 110*u* connecting portion

The invention claimed is:

1. A plant facility comprising:

a plurality of plant configuring modules that extend in a direction along a first end of a first connecting beam and extend in the direction along a second end of the first connecting beam, wherein each plant configuring module of the plant configuring modules includes a frame body with a lower frame member having a rectangular shape, an upper frame member arranged on an upper side of the lower frame member, and a column member that couples the upper frame member and the lower frame member, and a plant element arranged inside the frame body, and that builds the plant facility constructed by combining a plurality of plant configuring modules, wherein the upper frame member and the lower frame member include a connecting portion that connects the first connecting beam arranged between the plant configuring modules, wherein the column member is formed with a projecting column portion that projects out from one side or both sides of the lower frame member and the upper frame member;

a first pass-through region defined by the first connecting beam and a dimension between a projecting column portion of a lower frame member of a first frame body and a projecting column portion of an upper frame member of a second frame body, the first pass-through region further defined by the first connecting beam and a dimension between a projecting column portion of a lower frame member of a third frame body and a projecting column portion of an upper frame member of a fourth frame body, a second pass-through region defined by a second connecting beam and a dimension between the projecting column portion of the lower frame member of the third frame body and a dimension between a projecting column portion of a lower frame member of a fifth frame body, the second pass-through region further defined by the second connecting beam and a dimension between the projecting column portion of the lower frame member of the fourth frame body and a dimension between a projecting column portion of a lower frame member of a sixth frame body, wherein the first pass-through region is formed between overlapped frame bodies of plant configuring modules and comprises a first passage that extends in a horizontal direction in-between the first frame body and the second frame body and in-between the third frame body and the fourth frame body, wherein the first frame body is adjacent the second frame body in a planar direction and the third frame body is adjacent the fourth frame body in the planar direction, wherein the planar direction is perpendicular to the horizontal direction, wherein the second pass-through region is formed between overlapped frame bodies of plant configuring modules and comprises a second passage that extends in the planar direction in-between the third frame body and the fifth frame body and extends in-between the fourth frame body and the sixth frame body; and a flange plate for bonding is arranged at a distal end of the projecting column portion.

2. The plant facility according to claim 1, wherein the connecting portion is adjacently arranged by a predetermined dimension.

3. The plant facility according to claim 1, wherein a bolt hole is opened in the flange plate, and the plant configuring modules of the plant facility that are adjacently arranged are connectable with a bolt and a nut.

4. The plant facility according to claim 1, wherein the plant element is arranged in a state of being bondable with the plant element arranged in the plant configuring module of the adjacently constructed plant configuring module.

5. The plant facility according to claim 1, wherein the plant configuring module having the projecting column portion only on the upper frame member is arranged at a bottom of the plant facility.

6. The plant facility according to claim 1, wherein the plant configuring module having the projecting column portion only on the lower frame member is arranged at a top of the plant facility.

7. The plant facility according to claim 1, wherein the upper frame member includes a first member arranged at a predetermined height position along one of two intersecting directions in which a member configuring the lower frame member is arranged, and a second member arranged along the other of the two directions and arranged at a height position different from the first member.

8. A plant facility comprising:

a plurality of plant configuring modules that extend in a direction along a first end of a first connecting beam and extend in the direction along a second end of the first connecting beam, wherein each plant configuring module of the plant configuring modules includes a frame body with a lower frame member having a rectangular shape, an upper frame member arranged on an upper side of the lower frame member, and a column member that couples the upper frame member and the lower frame member, and a plant element arranged inside the frame body, and that builds the plant facility constructed by combining a plurality of plant configuring modules, wherein the upper frame member and the lower frame member include a connecting portion that connects the first connecting beam arranged between the plant configuring modules, wherein the column member is formed with a projecting column portion that projects out from one side or both sides of the lower frame member and the upper frame member, wherein the upper frame member includes a first member arranged at a predetermined height position along one of two intersecting directions in which a member configuring the lower frame member is arranged, and a second member arranged along the other of the two directions and arranged at a height position different from the first member;

a first pass-through region defined by the first connecting beam and a dimension between a projecting column portion of a lower frame member of a first frame body and a projecting column portion of an upper frame member of a second frame body, the first pass- through region further defined by the first connecting beam and a dimension between a projecting column portion of a lower frame member of a third frame body and a projecting column portion of an upper frame member of a fourth frame body, a second pass-through region defined by a second connecting beam and a dimension between the projecting column portion of the lower frame member of the third frame body and a dimension between a projecting column portion of a lower frame member of a fifth frame body, the second pass-through region further defined by the second connecting beam and a dimension between the projecting column portion of the lower frame member of the fourth frame body and a dimension between a projecting column portion of a lower frame member of a sixth frame body, wherein the first pass-through region is formed between overlapped frame bodies of plant configuring modules and comprises a first passage, that extends in a horizontal direction in-between the first frame body and the second frame body and in-between the third frame body and the fourth frame body, wherein the first frame body is adjacent the second frame body in a planar direction and the third frame body is adjacent the fourth frame body in the planar direction, wherein the planar direction is perpendicular to the horizontal direction, wherein the second pass-through region is formed between overlapped frame bodies of plant configuring modules and comprises a second passage that extends in the planar direction in-between the third frame body and the fifth frame body and extends in-between the fourth frame body and the sixth frame body; and a flange plate for bonding is arranged at a distal end of the projecting column portion.

9. The plant facility according to claim 1, wherein the frame bodies of plant configuring modules are not arranged in a directly overlapping manner.

10. The plant facility according to claim 8, wherein the frame bodies of plant configuring modules are not arranged in a directly overlapping manner.

11. The plant facility according to claim 8, wherein connecting portion is adjacently arranged by a predetermined dimension.

12. The plant facility according to claim 1, further comprising a diagonal member arranged between the first connecting beam and the column member.

13. The plant facility according to claim 8, further comprising a diagonal member arranged between the first connecting beam and the column member.

* * * * *